United States Patent [19]

Berlin

[11] 3,960,376

[45] *June 1, 1976

[54] BALANCING SKILL GAME

[76] Inventor: Evan H. Berlin, 119 Dunn Ave., Lake City, Pa. 16423

[ * ] Notice: The portion of the term of this patent subsequent to Jan. 8, 1991, has been disclaimed.

[22] Filed: Aug. 31, 1973

[21] Appl. No.: 393,312

Related U.S. Application Data

[63] Continuation-in-part of Ser. No. 274,707, July 24, 1972, Pat. No. 3,784,196.

[52] U.S. Cl. ..... 273/1 E; 35/22 R; 46/228

[51] Int. Cl.[2] ..... A61B 5/16; A63F 9/06

[58] Field of Search ..... 273/1 R, 1 E; 272/21, 272/25; 46/228; 35/22 R

[56] References Cited

UNITED STATES PATENTS

| | | | |
|---|---|---|---|
| 3,197,757 | 7/1965 | Porta | 46/228 UX |
| 3,411,777 | 11/1968 | Durland | 273/1 R |
| 3,680,545 | 8/1972 | Miller | 273/1 E X |
| 3,707,055 | 12/1972 | Pearce | 46/228 |
| 3,784,196 | 1/1974 | Berlin | 273/1 E |

*Primary Examiner*—Paul E. Shapiro

[57] ABSTRACT

An elongated substantially cylindrical toy simulating the head end portion of a cobra including a throat portion, hood, and head, and having a base member opposite the head which is adapted to be balanced in an upright position in the palm of a player's hand. An electrical circuit, including lamps selectively located in the toy and a source of electrical energy is contained by the toy which selectively energizes the lamps in a predetermined sequence in timed intervals while the toy remains balanced. The cobra can be made in two sections for easy assembly.

8 Claims, 7 Drawing Figures

BALANCING SKILL GAME

REFERENCE TO RELATED APPLICATIONS

This application is a continuation-in-part of patent application, Ser. No. 274,707, filed July 24, 1972, now U.S. Pat. No. 3,784,196.

BACKGROUND OF INVENTION

1. Field of the Invention

The present invention relates to games of skill and more particularly to a toy comprising an elongated hollow member simulating a snake, such as a cobra, or the like, which contains an electrical circuit for illuminating portions of the toy during a balancing act.

2. Description of the Prior Art

I do not know of any patents disclosing a game or toy which is illuminated in a sequence determined by time lapse while the toy is balanced by a user.

SUMMARY OF THE INVENTION

An elongated substantially cylindrical hollow toy, having a base end, simulates at its other end the configuration of a snake, such as a cobra, having a neck portion, laterally projecting hood portions and a head including eyes. The toy is preferably formed of translucent plastic material such as high impact styrene. The hollow interior of the toy contains an electrical circuit including a source of electrical energy disposed adjacent the base end, a lamp located in the throat area, a lamp or a pair of lamps located in the hood and a lamp illuminating the eyes. Time delay means in the circuit successively illuminates the lamps and de-energizes them in sequence during such time as the toy remains balanced in an upright position while supported by the user's hand. In the event balance of the toy is lost by a player during a game, one or more of a plurality of gravity actuated mercury switches, or of one or more gravity activated magnetic reed switches, opens the circuit and interrupts the lamps illuminating sequence.

OBJECTS OF THE INVENTION

The principal object of this invention is to provide a game toy for improving the balancing skill of users wherein portions of the toy are illuminated in sequence by a plurality of lamps during a predetermined period of time during which balance of the toy must be maintained.

Another object is to provide a novel display device suitable for display by a fireplace, in a living room or the like.

GENERAL DESCRIPTION OF THE DRAWINGS

DETAILED DESCRIPTION OF THE DRAWINGS

Figure 1:
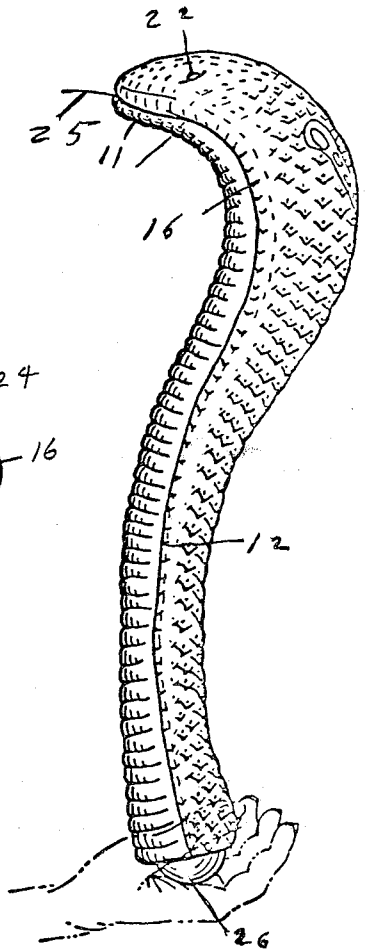
FIG. 1 is a side view of the toy according to the invention.
Figure 6:
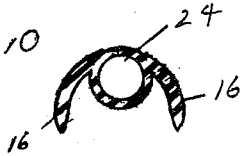
FIG. 6 is a cross sectional view taken on line 6—6 of FIG. 3.
Figure 2:
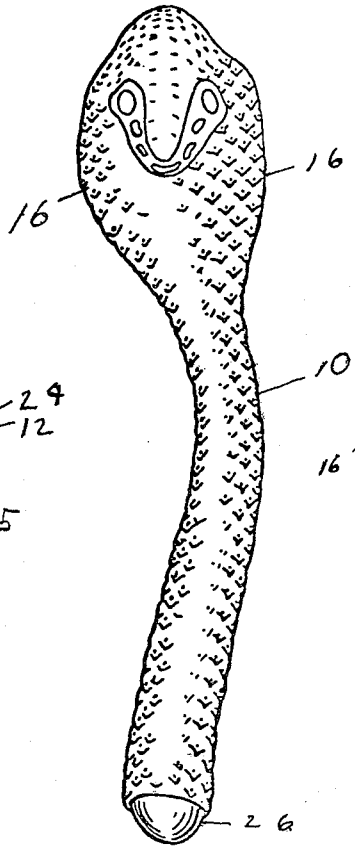
FIG. 2 is a rear view of the toy.
Figure 5:
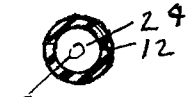
FIG. 5 is a cross sectional view taken on line 5—5 of FIG. 3.
Figure 3:
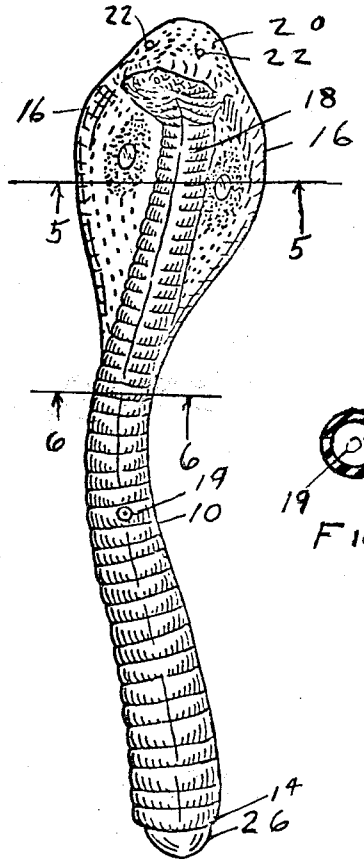
FIG. 3 is a front view of the toy.
Figure 4:
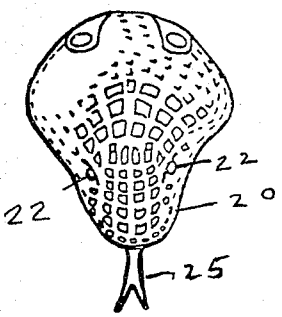
FIG. 4 is a top view of the toy.
Figure 7:
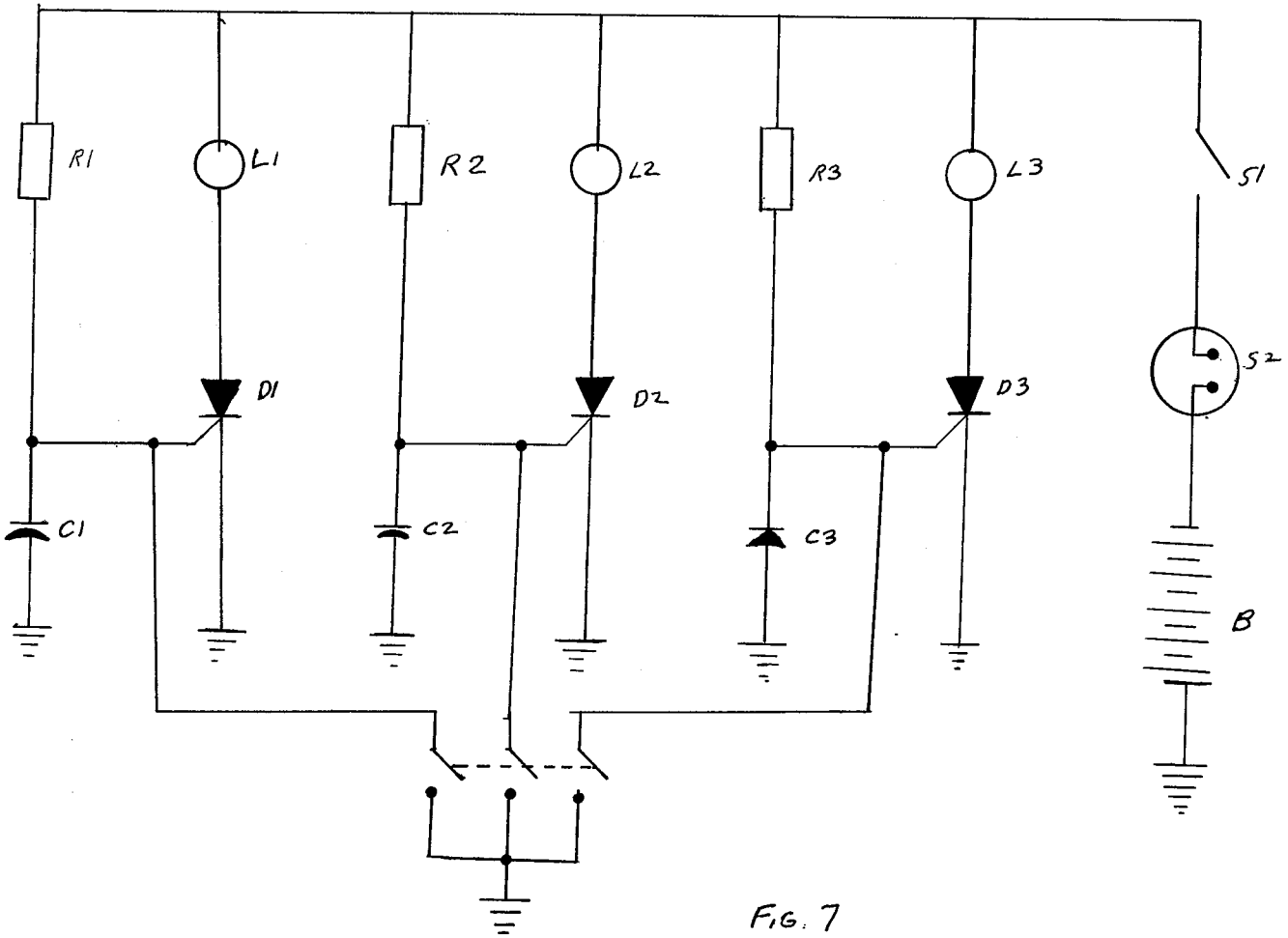
FIG. 7 is a schematic diagram of the electrical circuit.

The reference numeral 10 indicates the toy, as a whole, which is preferably formed of translucent plastic material, such as high impact styrene, elongated cylindrical in general configuration, which can be molded in a top half and a bottom half with parting line 12 between the halves, which extends along the sides and terminates at the mouth at 11. The body can be so constructed that it can be easily taken apart along the parting line 12 to service the electrical circuit. The other end portion simulates a snake, such as a cobra, having opposing longitudinally extending laterally projecting hoods 16 defining a throat portion 18 and terminating in a snake head shape 20 including a pair of eyes 22. It has tongue 25 fixed to the mouth. The toy is provided with a hollow interior, indicated at 24, which extends upwardly from its base end 14 to at least the position of the eyes 22. The base end 14 is normally closed by a base member or cap 26 which may be pressed into the hollow body at 12. This hollow interior 24 contains an electrical circuit shown in FIG. 7. The circuit principally consists of three interconnected similar time delay configurations or sections employed to illuminate a plurality of different lamps L1, L2 and L3 in a predetermined sequence, each for a predetermined time interval, for example, thirty seconds each for the lamp L1, the lamp or pair of lamps L2, and a shorter interval of time, for example, fifteen seconds for the lamp L3, total of 3 to 30 seconds sequences. The lamp L1 is preferably located in the body area 19 while the lamp or pair of lamps L2 are located in the respective hoods 16. The lamp L3 is located adjacent the eyes 22.

OPERATION

The circuitry consists of a source of power or battery B1, a gravity actuated switch or switches S1, such as mercury switches, a number of timing circuits that may be similar to each other, and a number of lamps to provide illumination.

The source of power B1 may consist of four 1.5 volts size "D" flashlight cells connected in series.

The gravity actuated switch S1, in the preferred example, consists of one or more mercury switches, or of one or more magnetic reed switches, arranged to complete the circuit when and only when the toy is balanced in a vertical position.

The timing circuits each consists of an integrated circuit and a number of discrete resistors and capacitors.

One or more lamps are connected to each timing circuit to illuminate the toy in a predetermined sequence.

The timing circuit consisting of D1, R1, C1 is arranged so that when the toy is balanced, lamp L1 lights. Lamp L1 remains lit for a time period determined by the values of R1 and C1. Specifically, the time in seconds is equal to 1.1 times the value of R1 in ohms, times the value of C1 in farads. At the end of this time period, the circuit through L1 is broken and lamp L1 extinguishes and the next timing circuit is triggered.

The next timing circuit consists of 1C2, R2 and D2. This timing circuit is arranged so that when lamp L1 is extinguished, lamp L2 illuminates. Lamp L2 remains lit for an amount of time determined by the values of R2 and C2. Specifically, the time in seconds is equal to 1.1 times the value of R2 in ohms times the value of C2 in farads. At the end of this time period, lamp L2 extinguishes and the next timing circuit is triggered.

The next timing circuit consists of C3, R3 and D3. This timing circuit is arranged so that when lamp L2 is extinguished, lamp L3 illuminates. Lamp L3 remains lit for an amount of time determined by the values of C3 and R3. Specifically, the time in seconds is equal to 1.1 times the value of R3 in ohms times the value of C3 in farads. At the end of this time period, lamp L3 extinguishes.

The general operation of the circuitry is such that lamps L1, L2, and L3 are illuminated and extinguished in sequence. All lamps remain unlit until the toy is balanced in a vertical position; at that time, lamp L1 lights, and assuming that balance is maintained, after a time lamp L1 extinguishes and lamp L2 lights. Assuming that balance is still maintained, after a time, lamp L2 extinguishes and lamp L3 lights. If balance is further maintained for a time, lamp L3 extinguishes.

If balance of the toy is lost by the person holding it, all lamps extinguish immediately. The lighting sequence will only restart when the toy is again held in the vertical position.

The above operation of the circuitry is general only and may be modified to include different time delays and more individual time delay circuits.

Since the battery drain of this circuitry is zero unless vertical position is maintained, and negligible once the timing sequence is completed, even though vertical balance is maintained, an on-off switch is unnecessary.

Since the timing sequence is started as soon as vertical balance is attained, a reset switch is unnecessary.

Obviously the invention is susceptible to changes or alterations without defeating its practicability, therefore, I do not wish to be confined to the preferred embodiment shown in the drawings and described herein.

The embodiments of the invention in which an exclusive property or privelege is claimed are defined as follows:

1. A toy comprising, an elongated hollow body made in a first half and a second half and fixed together, an electrical circuit contained by said body, said circuit comprising a plurality of lamps, a source of electrical energy in series with each of said lamps, time delay means in circuit with said source of electrical energy and said lamps for causing said lamps to become illuminated sequentially and inclination sensitive means in series circuit between said source of electrical energy and said lamps for controlling current through said circuit, and breaking said circuit when said body is inclined beyond a certain angle.

2. The toy according to claim 1, wherein said inclination sensitive means further includes:

a current source wire, a plurality of switches connected in series between said current source and said current source wire, said switches being normally closed when said body is disposed vertically and at least one of said switches being opened in response to said body being inclined beyond a predetermined angle with respect to the surface of the earth.

3. The toy according to claim 2 wherein said plurality of lamps are disposed in spaced apart relation throughout at least one end portion of said body.

4. The toy according to claim 1 wherein said elongated body is in the form of a cobra having a cobra body, a cobra head and eyes, said plurality of lamps comprising a first lamp in said cobra body, a second lamp in said head, and third lamps in said eyes.

5. The toy according to claim 4 in which said time delay means includes a plurality of time delay sections, each said time delay section being connected with at least one of said plurality of lamps and illuminating and extinguishing said lamps in sequence when said toy is held continuously in vertical position.

6. The toy according to claim 5 in which each said time delay section includes a resistor in parallel circuit with said lamp and a capacitor in series circuit with said resistor and source of electrical energy.

7. The toy according to claim 6 wherein said body is characterized by an essentially hollow body and, a cover through which to insert batteries, and a cap closing the base end, said body being made of two longitudinal halves.

8. The toy according to claim 7 wherein said body is formed of translucent material and said head end portion simulates the head end portion of a snake.

* * * * *